US011371771B2

(12) United States Patent
Alves Ferreira et al.

(10) Patent No.: US 11,371,771 B2
(45) **Date of Patent: *Jun. 28, 2022**

(54) HOUSEHOLD APPLIANCE COMPRISING SHELF ARRANGEMENT

(71) Applicant: WHIRLPOOL CORPORATION, Benton Harbor, MI (US)

(72) Inventors: Luiz Afranio Alves Ferreira, Joinville (BR); Edson Isaltino Bento, Joinville (BR); Guilherme Nehring, Joinville (BR); Ademar Testoni, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 22 days.

This patent is subject to a terminal disclaimer.

(21) Appl. No.: 16/908,470

(22) Filed: Jun. 22, 2020

(65) Prior Publication Data

US 2020/0318892 A1 Oct. 8, 2020

Related U.S. Application Data

(63) Continuation of application No. 15/973,416, filed on May 7, 2018, now Pat. No. 10,690,400.

(30) Foreign Application Priority Data

May 11, 2017 (BR) ..... 1020170099679

(51) Int. Cl.
*F25D 25/02* (2006.01)
*F25D 23/06* (2006.01)

(52) U.S. Cl.
CPC ..... *F25D 25/025* (2013.01); *F25D 25/021* (2013.01); *F25D 23/067* (2013.01)

(58) Field of Classification Search
CPC ..... F25D 25/021; F25D 25/025
(Continued)

(56) References Cited

U.S. PATENT DOCUMENTS 774,117 A 11/1904 Tandy
1,952,148 A 3/1934 Stout
(Continued)

FOREIGN PATENT DOCUMENTS

BR PI0100491 B1 6/2009
BR PI0805999 A2 6/2010
(Continued)

OTHER PUBLICATIONS

GE Appliances, Refrigerator Capacity & Organization: Making Room for More, Jan. 17, 2014, http://www.geappliances.com/appliances/refrigerators/refrigerator-capacity-organize.htm.
(Continued)

*Primary Examiner* — James O Hansen
(74) *Attorney, Agent, or Firm* — Price Heneveld LLP

(57) ABSTRACT

The present disclosure refers to a household refrigeration appliance and, more specifically, to a household refrigeration appliance with a multifunctional shelf. A multifunctional shelf arrangement is provided, including: a shelf comprising a frame that is physically associated to the walls of an internal box by shelf rails; the frame comprising lateral, front and rear portions, as well as at least one accessory physically associated to the shelf by accessory rails defining at least one track for displacement of the accessory. Specifically, in accordance with this disclosure, the frame comprises a plurality of receiving structures and the accessory rails comprise fitting projections which engage directly with the receiving structures of the frame, so that the attachment rails are removably fitted with the receiving structures.

17 Claims, 5 Drawing Sheets

(58) Field of Classification Search
USPC ..... 312/330.1, 401, 408, 410
See application file for complete search history.

(56) References Cited

U.S. PATENT DOCUMENTS 1,997,432 A 4/1935 Replogle
2,065,391 A 12/1936 Nance
2,187,916 A 1/1940 Seeger
2,225,762 A 12/1940 Barnsteiner
2,282,342 A 5/1942 Preble
2,412,904 A 12/1946 Money et al.
2,434,117 A 1/1948 Money et al.
2,466,360 A 4/1949 Bitney
2,509,592 A 5/1950 Giffard
2,517,385 A 8/1950 Clark
2,573,272 A 10/1951 Petkwitz
2,597,267 A 5/1952 Shoemaker et al.
2,694,906 A 11/1954 Didion
2,710,993 A 6/1955 Kirkpatrick
2,737,782 A 3/1956 Antico
2,742,559 A 4/1956 Edelman
2,748,573 A 6/1956 Staebler et al.
2,773,677 A 12/1956 Hinkel
2,804,068 A 8/1957 Miller et al.
2,841,132 A 7/1958 Philipp
2,875,016 A 2/1959 Fry
3,266,858 A 8/1966 Klotz
3,295,904 A 1/1967 Cobb
3,410,260 A 11/1968 Morgan
3,866,437 A 2/1975 Spencer
3,984,163 A 10/1976 Boorman, Jr. et al.
4,638,644 A 1/1987 Gidseg
4,729,613 A 3/1988 Tromble et al.
4,732,435 A 3/1988 Bailey et al.
4,735,470 A 4/1988 Falk
4,834,557 A 5/1989 Dreinhoff
4,914,928 A 4/1990 Fellwock et al.
4,998,382 A 3/1991 Kostos et al.
5,044,704 A 9/1991 Bussan et al.
5,273,354 A 12/1993 Herrmann et al.
5,362,145 A 11/1994 Bird et al.
5,415,472 A 5/1995 Brise
5,429,043 A 7/1995 Becker
5,447,146 A 9/1995 Nickerson
5,524,981 A 6/1996 Herrmann et al.
5,564,809 A 10/1996 Kane et al.
5,660,777 A 8/1997 Herrmann et al.
5,735,589 A 4/1998 Herrmann et al.
5,813,741 A 9/1998 Fish et al.
5,918,959 A 7/1999 Lee
5,947,573 A 9/1999 Tovar et al.
6,045,101 A 4/2000 Goyette et al.
6,174,482 B1 1/2001 Reames et al.
6,220,684 B1 4/2001 Bent et al.
6,474,094 B2 11/2002 Kim
6,488,347 B1 12/2002 Bienick
6,604,800 B2 8/2003 Hamilton
6,679,573 B2 * 1/2004 Bienick ..... F25D 25/024 312/408
6,811,045 B1 11/2004 Masker et al.
D505,140 S 5/2005 Reed et al.
D516,100 S 2/2006 Vardon
D516,102 S 2/2006 Vardon
D523,034 S 6/2006 Vardon
7,059,693 B2 6/2006 Park
D525,633 S 7/2006 Vardon
7,070,249 B2 7/2006 Leimkuehler et al.
7,131,545 B1 11/2006 Grogan
7,178,890 B2 2/2007 Park et al.
7,188,738 B2 3/2007 Stafford et al.
7,232,194 B2 6/2007 Becke et al.
D551,262 S 9/2007 Becker
7,270,385 B2 9/2007 Mathur et al.
7,467,834 B2 12/2008 Kim et al.
7,552,983 B2 6/2009 Shin
7,651,182 B2 1/2010 Eveland et al.
7,726,753 B2 6/2010 Bassi
7,748,569 B2 7/2010 Sunatori
7,748,806 B2 7/2010 Egan
7,878,344 B2 2/2011 Martin et al.
7,976,113 B2 7/2011 Gwak
D656,970 S 4/2012 Merritt
8,167,390 B2 * 5/2012 Koo ..... F25D 25/024 312/408
8,172,347 B2 5/2012 Lim et al.
8,182,056 B2 5/2012 Gossens et al.
8,240,512 B2 8/2012 Sunatori
D669,506 S 10/2012 Czach et al.
8,297,726 B2 10/2012 Ramm et al.
8,336,976 B2 12/2012 Lee
8,348,362 B2 1/2013 Candeo et al.
8,359,881 B2 1/2013 Junge et al.
8,381,949 B2 2/2013 Sunatori
8,403,438 B2 3/2013 Park et al.
8,414,095 B2 4/2013 Stewart
8,444,239 B2 5/2013 Gossens et al.
D692,034 S 10/2013 Seo et al.
8,562,089 B2 10/2013 Collins et al.
D694,288 S 11/2013 Hottmann et al.
D694,289 S 11/2013 Hottmann et al.
D694,292 S 11/2013 Eby et al.
8,616,665 B2 12/2013 Czach et al.
8,640,482 B2 2/2014 Lim et al.
8,726,689 B2 5/2014 Jung et al.
8,733,862 B1 5/2014 Armstrong et al.
D707,267 S 6/2014 Choi et al.
8,739,568 B2 6/2014 Allard et al.
D709,927 S 7/2014 Park et al.
8,777,341 B2 7/2014 Amaral et al.
D710,405 S 8/2014 Seo et al.
D710,406 S 8/2014 Seo et al.
D711,943 S 8/2014 Park et al.
8,833,882 B2 9/2014 Seo et al.
D714,840 S 10/2014 Yang et al.
D717,349 S 11/2014 Seo et al.
D719,986 S 12/2014 Kim et al.
8,960,826 B2 2/2015 Choo et al.
9,033,437 B2 5/2015 Klitzing et al.
D734,784 S 7/2015 Kim et al.
9,097,457 B2 8/2015 Kim
9,103,582 B2 8/2015 Nash et al.
9,127,878 B2 9/2015 Gossens et al.
9,151,534 B2 10/2015 Lee et al.
D745,581 S 12/2015 Jeon et al.
9,217,601 B2 12/2015 Koo et al.
D747,369 S 1/2016 McConnell et al.
D747,370 S 1/2016 Kim et al.
D747,371 S 1/2016 Lee et al.
D747,372 S 1/2016 Kim et al.
D747,373 S 1/2016 Lee et al.
D748,165 S 1/2016 McConnell et al.
9,234,690 B2 1/2016 McCollugh et al.
9,250,010 B2 2/2016 De La Garza et al.
9,297,573 B2 3/2016 Krause et al.
D754,759 S 4/2016 McConnell et al.
9,320,368 B2 4/2016 Marotti et al.
9,328,955 B2 5/2016 Castro Solis et al.
9,339,993 B2 5/2016 Cites et al.
D761,884 S 7/2016 Austin et al.
9,488,405 B2 11/2016 Lee et al.
9,500,403 B2 11/2016 Seo et al.
9,510,679 B2 12/2016 Bhatt et al.
9,671,115 B2 6/2017 Elkasevic
9,945,601 B1 4/2018 Bhavsar et al.
2003/0020387 A1 1/2003 Wing et al.
2004/0012314 A1 1/2004 Hay et al.
2004/0104323 A1 6/2004 Hubert et al.
2005/0073225 A1 4/2005 Kwon et al.
2006/0042305 A1 3/2006 Oh et al.
2006/0049731 A1 3/2006 Choi et al.
2006/0145577 A1 7/2006 Daley et al.
2006/0226749 A1 10/2006 Kim
2006/0226751 A1 10/2006 Park
2007/0126325 A1 6/2007 Gorz et al.

(56) References Cited

U.S. PATENT DOCUMENTS

| | | | |
|---|---|---|---|
| 2008/0203041 | A1 | 8/2008 | Lim et al. |
| 2008/0315743 | A1 | 12/2008 | Oh |
| 2009/0193836 | A1 | 8/2009 | Ertz et al. |
| 2010/0024464 | A1 | 2/2010 | Hwang et al. |
| 2010/0102693 | A1 | 4/2010 | Driver et al. |
| 2010/0109498 | A1 | 5/2010 | Ramm et al. |
| 2010/0219731 | A1 | 9/2010 | Candeo et al. |
| 2011/0001415 | A1 | 1/2011 | Park et al. |
| 2011/0072846 | A1 | 3/2011 | Engel et al. |
| 2011/0115356 | A1 | 5/2011 | Nash et al. |
| 2012/0018434 | A1 | 1/2012 | Gwak |
| 2012/0024006 | A1 | 2/2012 | Knöll et al. |
| 2012/0091084 | A1 | 4/2012 | Amaral et al. |
| 2012/0223038 | A1 | 9/2012 | Bean |
| 2012/0248958 | A1 | 10/2012 | Ertz et al. |
| 2013/0020922 | A1 | 1/2013 | Jang |
| 2013/0219731 | A1 | 8/2013 | Zhang |
| 2013/0221823 | A1 | 8/2013 | Fidalgo |
| 2015/0034668 | A1 | 2/2015 | Minard et al. |
| 2015/0061484 | A1 | 3/2015 | Jeong et al. |
| 2015/0068999 | A1 | 3/2015 | Dart et al. |
| 2015/0107084 | A1 | 4/2015 | Craycraft et al. |
| 2015/0168048 | A1 | 6/2015 | Sexton et al. |
| 2015/0184929 | A1 | 7/2015 | Moon |
| 2016/0290707 | A1 | 10/2016 | Burke et al. |
| 2017/0086580 | A1 | 3/2017 | Conti |
| 2017/0181538 | A1 | 6/2017 | Azkue et al. |

FOREIGN PATENT DOCUMENTS

| | | | |
|---|---|---|---|
| CN | 101611281 | A | 12/2009 |
| CN | 201779952 | U | 3/2011 |
| CN | 102135363 | A | 7/2011 |
| CN | 102395849 | A | 3/2012 |
| CN | 102494496 | A | 6/2012 |
| CN | 202432813 | U | 9/2012 |
| CN | 102829604 | A | 12/2012 |
| CN | 102889744 | A | 1/2013 |
| CN | 104089457 | A | 10/2014 |
| DE | 8801508 | U1 | 6/1989 |
| DE | 10107646 | A1 | 8/2002 |
| DE | 102009045363 | A1 | 4/2011 |
| DE | 102013216974 | A1 | 4/2014 |
| DE | 102012223131 | A1 | 6/2014 |
| EP | 0577939 | A1 | 1/1994 |
| EP | 0579364 | B1 | 12/1997 |
| EP | 1790250 | A2 | 5/2007 |
| EP | 1349802 | B1 | 8/2008 |
| EP | 2072937 | A2 | 6/2009 |
| EP | 2098810 | A2 | 9/2009 |
| EP | 2424421 | B1 | 10/2015 |
| EP | 2760315 | B1 | 8/2016 |
| EP | 2926069 | B1 | 11/2016 |
| JP | H10115485 | A | 5/1998 |
| JP | H10122733 | A | 5/1998 |
| JP | H11237173 | A | 8/1999 |
| JP | 2002090054 | A | 3/2002 |
| KR | 100364994 | B1 | 12/2002 |
| KR | 20030061668 | A | 7/2003 |
| KR | 100431346 | B1 | 5/2004 |
| KR | 1020040070986 | | 8/2004 |
| KR | 20040095421 | A | 11/2004 |
| KR | 100559722 | B1 | 3/2006 |
| KR | 100756887 | B1 | 9/2007 |
| KR | 20100023474 | A | 3/2010 |
| KR | 20140022598 | A | 2/2014 |
| WO | 02014761 | A1 | 2/2002 |
| WO | 2004104504 | A1 | 12/2004 |
| WO | 2005012812 | A1 | 2/2005 |
| WO | 2007128734 | A1 | 11/2007 |
| WO | 2008015180 | A2 | 2/2008 |
| WO | 2009155679 | A2 | 12/2009 |
| WO | 2011009773 | A2 | 1/2011 |
| WO | 2011080109 | A2 | 7/2011 |
| WO | 2012025382 | A2 | 3/2012 |
| WO | 2012062670 | A2 | 5/2012 |
| WO | 2013126515 | A1 | 8/2013 |
| WO | 2015101430 | A1 | 7/2015 |
| WO | 2015101434 | A1 | 7/2015 |
| WO | 2015149832 | A1 | 10/2015 |
| WO | 2015165531 | A1 | 11/2015 |
| WO | 2016155784 | A1 | 10/2016 |
| WO | 2017005314 | A1 | 1/2017 |

OTHER PUBLICATIONS

GE Appliances, GE Profile Side by Side Refrigerators, Jan. 17, 2014, http://www.abt.com/ge/GE_Profile_SideBySide.

* cited by examiner

HOUSEHOLD APPLIANCE COMPRISING SHELF ARRANGEMENT

CROSS-REFERENCE TO RELATED APPLICATION

This application is a continuation of U.S. patent application Ser. No. 15/973,416, filed May 7, 2018, entitled "Household Appliance Comprising Shelf Arrangement," now issued as U.S. Pat. No. 10,690,400, which claims priority to Brazilian Patent Application No. BR 10 2017 009967 9, filed May 11, 2017, entitled "Household appliance comprising shelf arrangement," the disclosures of which are incorporated herein by reference in their entirety.

SUMMARY OF THE DISCLOSURE

The objects summarized above are fully achieved by a household appliance comprising a multifunctional shelf arrangement, including a shelf having a frame that is physically associated to the walls of an internal box by shelf rails. The frame includes lateral, front and rear portions, at least one accessory physically associated to the shelf by accessory rails defining at least one track for displacement of the accessory. The frame comprising a plurality of receiving structures and the accessory rails with fitting projections which cooperate directly with the receiving structures of the frame so the accessory rails are removably fit to the receiving structures.

More specifically, the receiving structures are arranged adjacent to the side portions and/or front and rear portions of the frame so as to extend transversely inward from the respective side portions and/or front and rear portions of the frame. The receiving structures are defined by an opening contour that outlines an opening wherein at least one locking hole is provided in the opening contour. Further, each projection for fitting the accessory rails includes at least one main portion which, when the accessory rail is assembled, extends in the direction of the opening and at least one quick-fitting latch able to engage the locking hole, the at least one quick-fitting latch extending transversely from the main portion.

In addition, at least two side accessory rails engage the side receiving frames mounted adjacent to the side portions of the frame and at least one central accessory rail engages with central receiving structures mounted adjacent to the front and rear portions of the frame.

In at least one instance, each side and center accessory rail comprises, respectively, at least one upper flange and at least one lower flange joined together by a main accessory rail wall, wherein at least one track per each one defined is arranged in the space adjacent to, respectively, at least one upper flange, at least one lower flange, and the main accessory rail wall, wherein each side accessory rail comprises respective main portions of the respective fitting projections extending transversely from its respective main accessory rail wall and each accessory central rail comprises main portions of the respective fitting projections extending longitudinally from the front and rear ends of its respective upper flange.

Each side receiving structure may include at least one bulkhead extending transversely from its respective opening contour, the bulkhead being able to seat the main accessory rail wall of the respective side accessory rail. In addition, it is noted that at least the main portions of the side accessory rails are defined by respective circumferential walls which delimit respective adjustment grooves. Optionally, at least one of the lateral or central accessory rails comprises, at its respective upper flange and/or lower flange, an accessory rail protrusion is able to engage with an accessory groove provided in the accessory, so as to provide secure fitting between the two in retracted position of the accessory. The frame may be made of a first polymeric material and the accessory rails may be made of a second polymeric material.

Furthermore, it is also expected that at least one of the walls of the internal box includes a respective recessed area delimited by at least one upper and one lower edge, with the recessed area receiving a respective side portion of the frame. The recessed area comprising a larger shoulder projecting into the interior of the internal box and extending parallel to the respective side portion of the frame, the larger shoulder comprising a middle portion and a recess extending from a first stopper to a second stopper. In this regard, at least one of the shelf rails is defined at least by the combination of the recessed area and the larger shoulder.

Furthermore, according to this proposal, at least one of the side portions of the frame includes the respective coupling profile which projects downward from the lower side of the side portion and extends in a direction parallel to that side portion; the coupling profile including, in a middle portion, locking projections with the coupling profile being able to engage the larger shoulder while the locking projections are able to be arranged in the recess, each juxtaposed with one of the first and second stoppers.

These and other features, advantages, and objects of the present disclosure will be further understood and appreciated by those skilled in the art by reference to the following specification, claims, and appended drawings.

BRIEF DESCRIPTION OF THE DRAWINGS

Further advantages and features according to the present disclosure will become clear from the following detailed description provided as a non-limiting example, with reference to the attached drawings.

The disclosure in question will be specified in detail on the basis of the following illustrative figures, of which.

Figure 1:
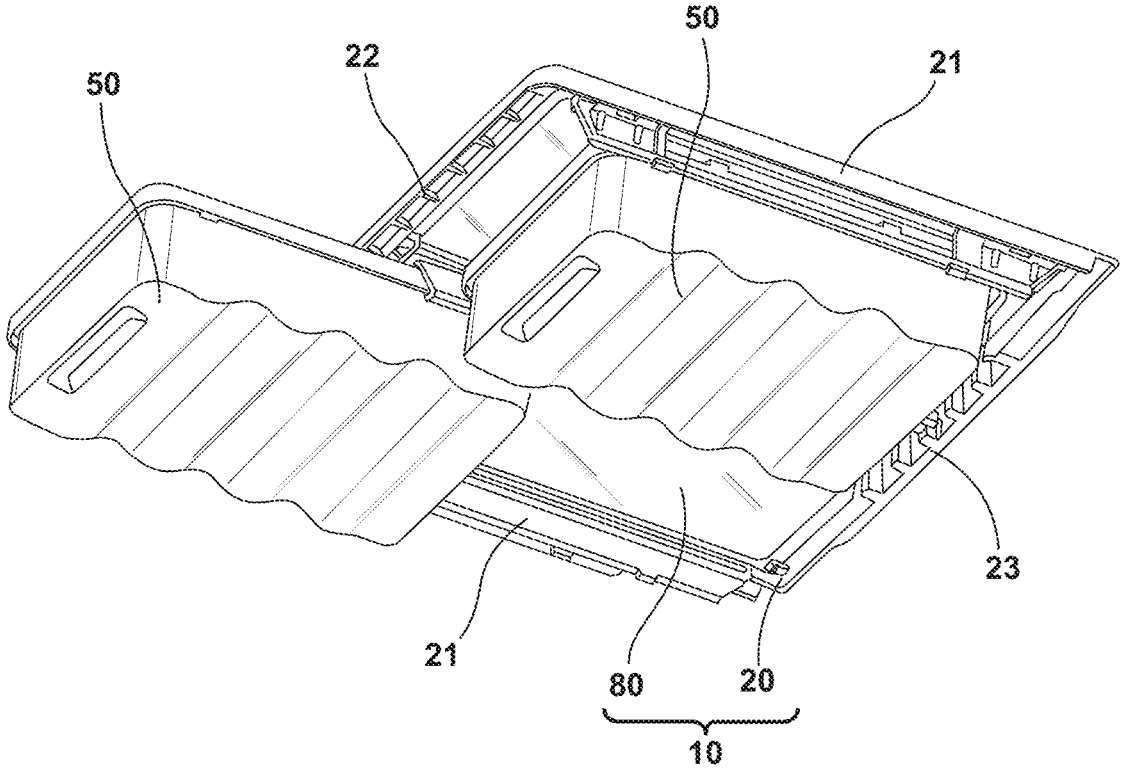
FIG. 1 shows a bottom perspective view of the shelf arrangement of the present disclosure with the accessory assembled.
Figure 2:
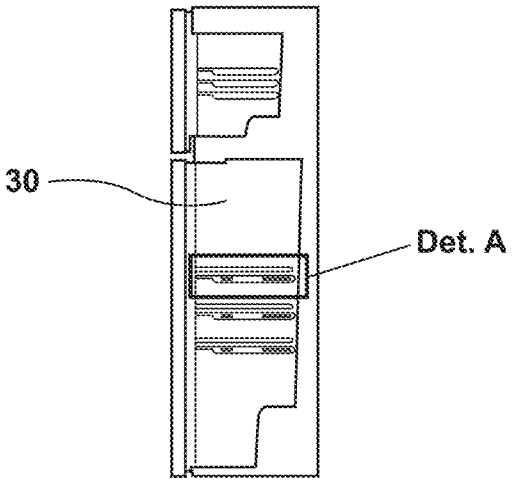
FIG. 2 shows a household appliance, in cross-section, highlighting detail A.
Figure 3:
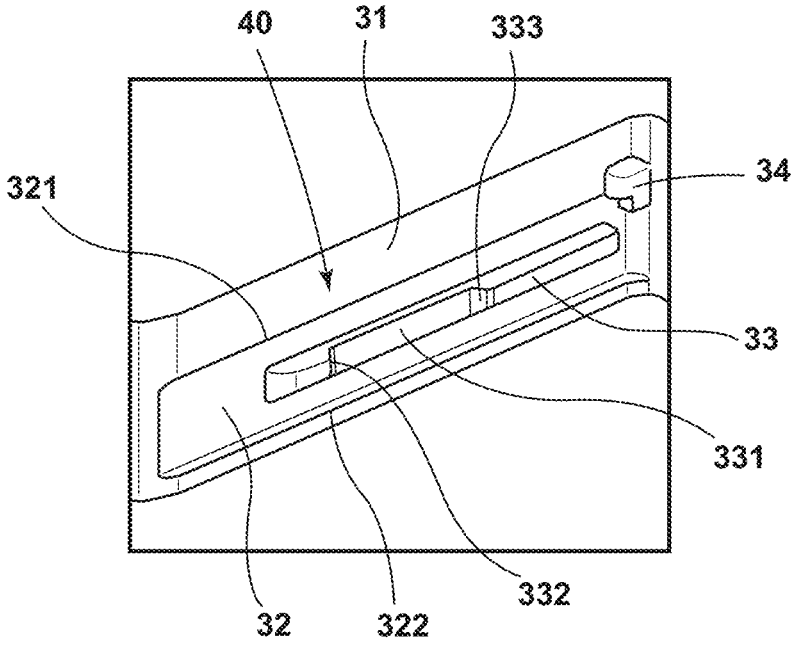
FIG. 3 shows detail A of FIG. 2, showing the elements that define the shelf rail of the appliance in question with the latter still disassembled.
Figure 4:
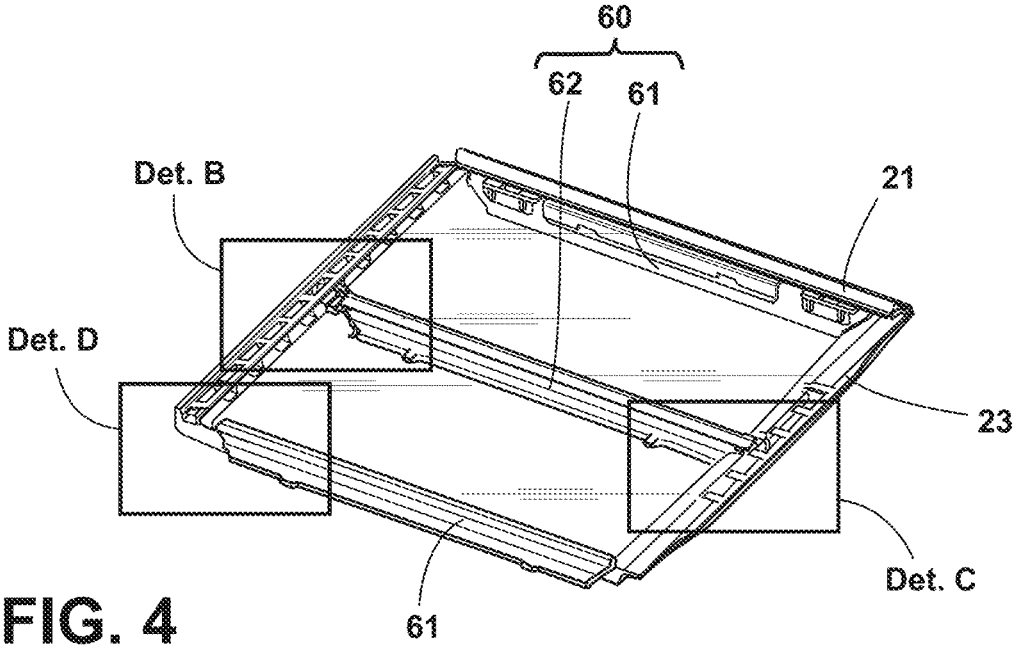
FIG. 4 illustrates a perspective view of the shelf arrangement of this disclosure without the accessory mounted, highlighting details C and D.
Figure 5:
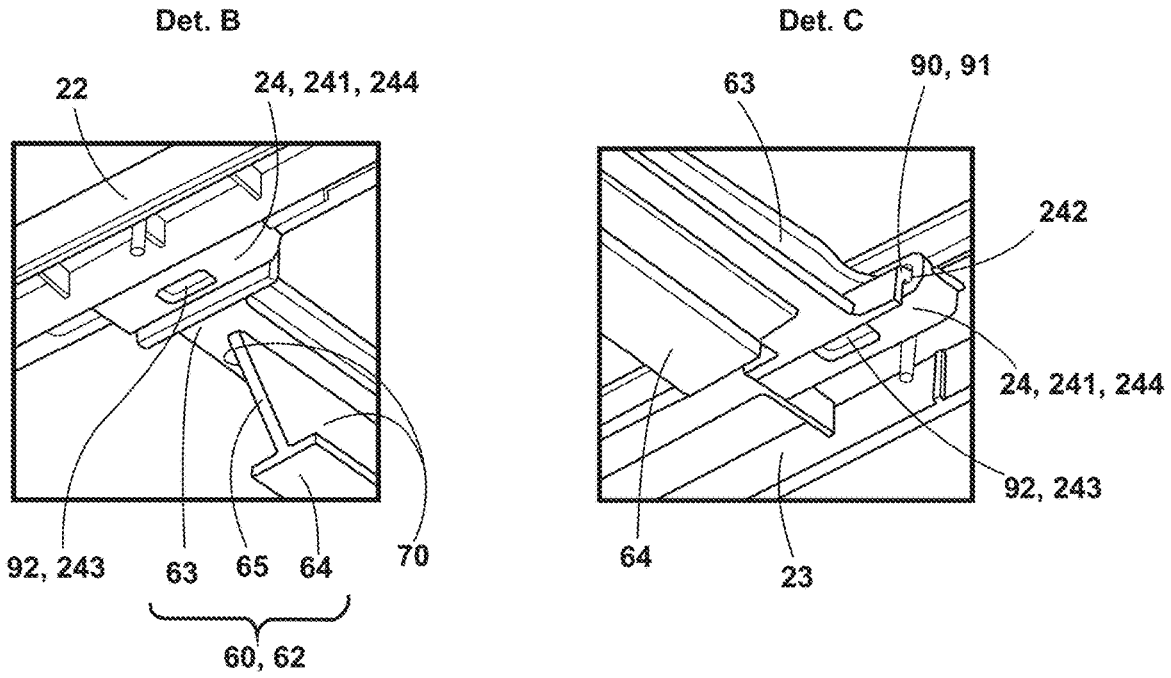
FIG. 5 shows details B and C of FIG. 4, displaying the components relating to the fitting between the accessory central rail and the frame of the shelf.
Figure 6:
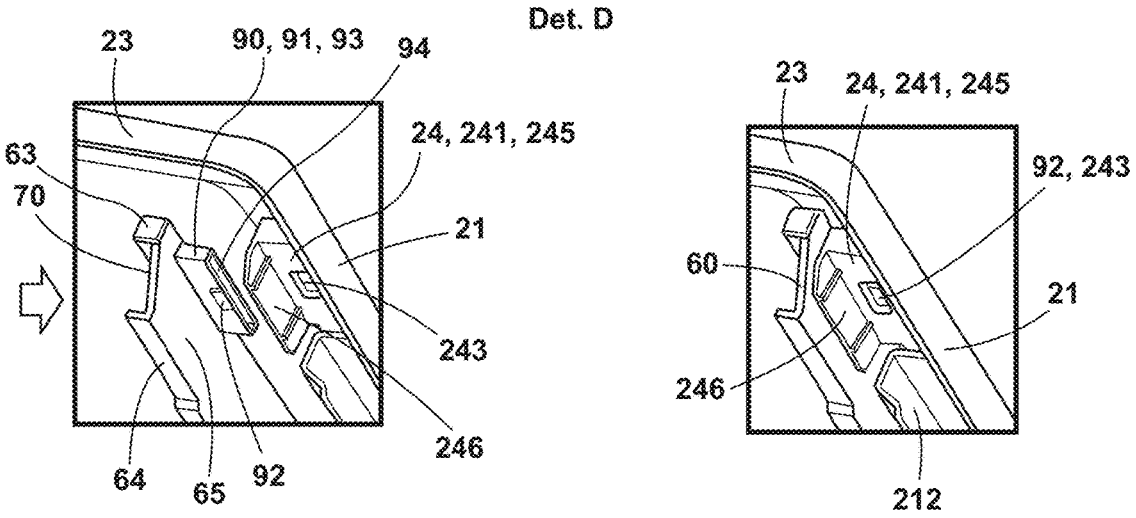
FIG. 6 shows detail D, in a rear-lower perspective displaying the components referring to the fitting between the side accessory rail and the shelf frame; in the left image the side accessory rail is disassembled and the arrow indicates the direction of assembly, while in the right-hand image the side accessory rail is already mounted.
Figure 7:
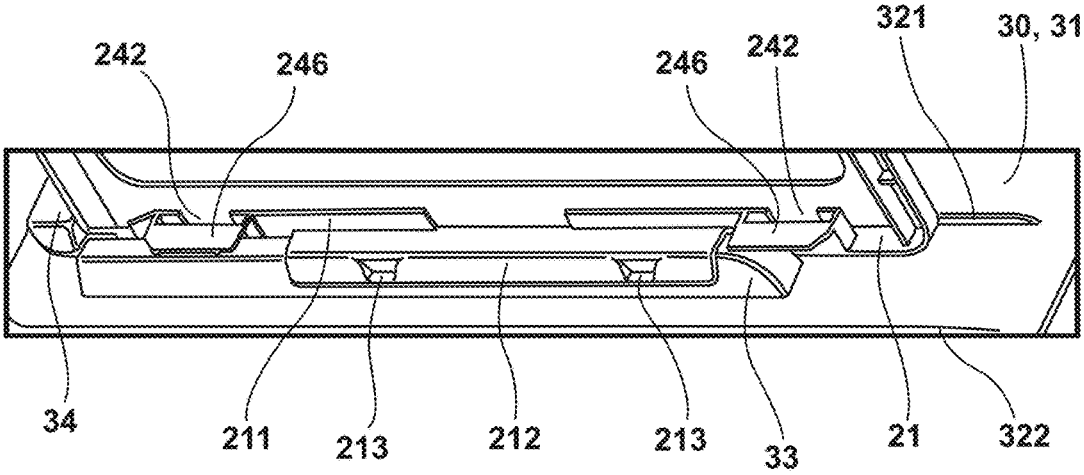
FIG. 7 shows a lower perspective of the shelf rail, with the latter already mounted.
Figure 8:
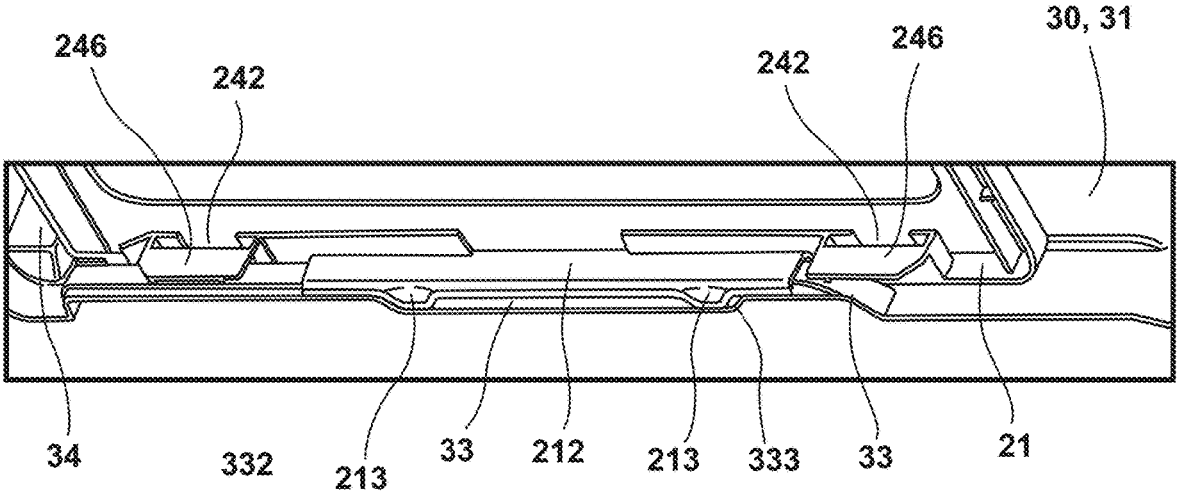
FIG. 8 shows a lower perspective, in longitudinal cross-section, of the shelf rail, with the latter already assembled.
Figure 9:
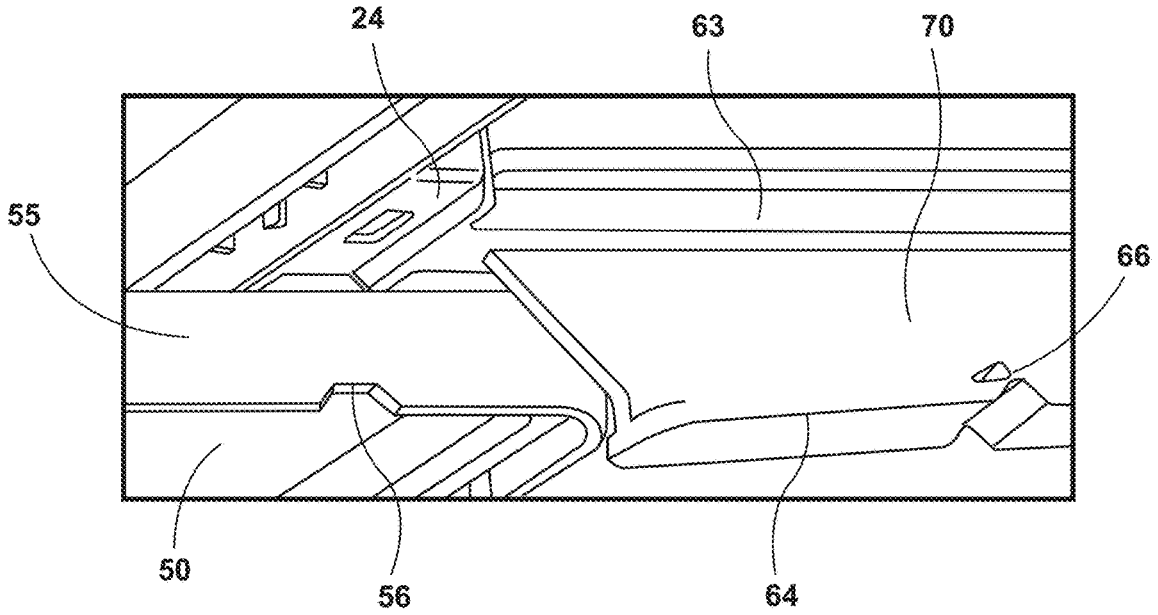
FIG. 9 shows in detail the fitting between the accessory rail and the accessory, namely the accessory groove and the accessory rail shoulder.
Figure 10:
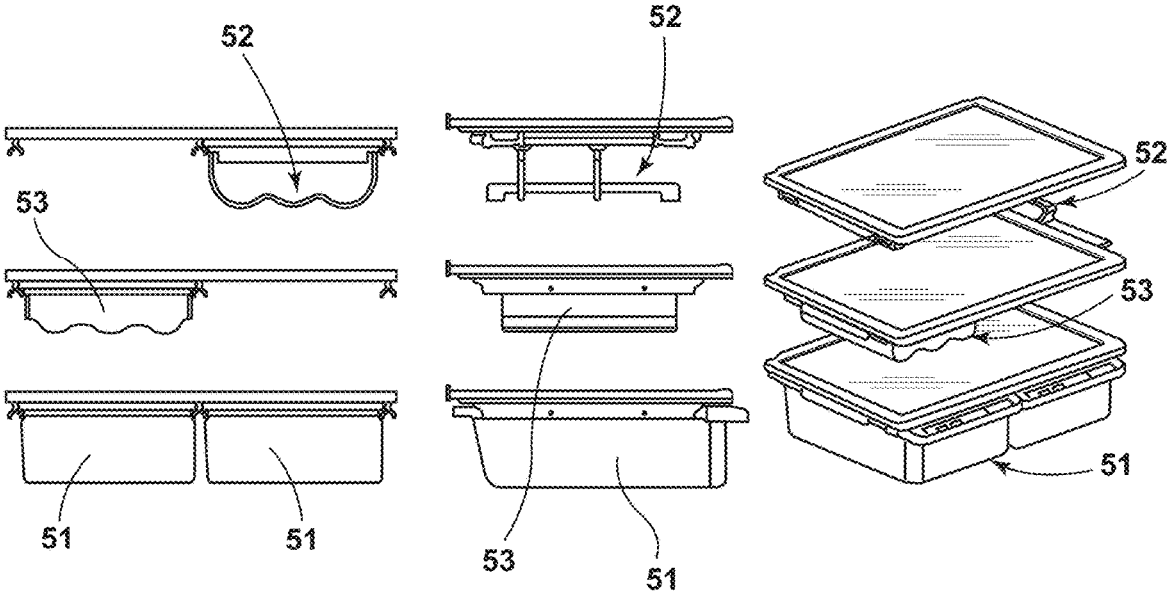
FIG. 10 shows front, side and perspective views of the different possible types of accessories that may be used in accordance with the present disclosure.

The components in the figures are not necessarily to scale, emphasis instead being placed upon illustrating the principles described herein.

DETAILED DESCRIPTION

The present disclosure refers to a refrigeration appliance and, more specifically, to a refrigeration appliance with a multifunctional shelf arrangement.

Many refrigerator models (refrigerators, freezers, etc.) include shelves on which to place items, which in addition to having sufficient strength to support the weights of items, may also include different characteristics designed for purposes of usability, practicality, and aesthetics, among other attributes. To satisfy the demand for an aesthetically attractive product and for easier maintenance, it has become increasingly common to use glass shelves, for example, which generally include a frame that allows them to fit into support elements within the refrigerator compartment.

In some designs, the support elements, which may take the form of shoulders or rails, are integrally formed with the side walls of the refrigerator compartment during the molding of the internal box of the refrigerator cabinet. In other designs, the support elements are manufactured separately and subsequently fastened to the walls of the compartment using any suitable process known in the art. At the same time, due to demands for quality and/or practicality, we point out the existence, in the state of the art, of a plurality of accessories for support and storage of the most varied types of items, for example, can-holder drawers, wine-bottle compartments, large drawers for fruits and vegetables, and egg-door compartments, among others, each with its own particularities.

Sometimes such accessories, as well as the shelves themselves, may also be displaced (alternating between a retracted position and a position of use) with regard to the structure to which they are physically associated, i.e. the internal refrigerator box itself, a shelf, or any other structure. In particular, due to their relevance to the present description, the movable accessories physically associated with shelves are pointed out.

Traditional constructions include shelf arrangements to which drawers and/or other movable accessories are physically associated with regard to their respective shelves by integrated rails, i.e. by non-modular rails. Problems can arise in relation to the provision of accessory rails in the shelf frame. The accessory rails end up being defined when the injection molding of the frame is carried out, so that both the shelf frame (or the shelf as a whole) and the rails associated with it are made of a single material, usually ABS polymer, due to its finishing quality (aesthetics). Use of the ABS polymer for the manufacture of the rails may not be exactly desirable in some instances, since this polymer does not have self-lubricating properties, which causes excessive wear of the rails in the long term, affecting the user perception of quality in what concerns the product.

With regard to the provision of physically movable accessories associated with refrigerator shelves, traditional constructions have the disadvantages of presenting complex and/or low quality, and/or less cost-effective methods of mounting the accessory rails along the respective shelves, as well as mounting the shelves themselves along the internal refrigerator box.

Therefore, in light of the foregoing, even though the solutions described above prove to be functional for the purposes for which they were designed, it is noted that there is still a gap in the state of the art regarding the provision of an arrangement which includes modular rails capable of holding a movable accessory, the arrangement being able to be securely mounted to the internal refrigerator box or the like, besides being simple, reliable and cost-effective.

Thus, one object of this disclosure is to provide a shelf arrangement that includes modular rails for mounting movable accessories on the shelves. Another object of this disclosure is to provide a shelf arrangement that includes secure fitting between the modular rails and the shelf itself, as well as between the shelf itself and the internal refrigerator box or the like. Another object is to describe a simple, inexpensive and high durability solution that is feasible for a variety of applications.

The present illustrated embodiments reside primarily in combinations of method steps and apparatus components related to a household appliance comprising a shelf arrangement. Accordingly, the apparatus components and method steps have been represented, where appropriate, by conventional symbols in the drawings, showing those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer of the display mirror, and the term "rear" shall refer to the surface of the element further from the intended viewer of the display mirror. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

With reference now to the figures, an appliance comprising a multi-functional shelf arrangement is displayed, including a shelf 10 comprising a frame 20 physically associated with walls 31 of an internal box 30 by shelf rails 40, the frame 20 enveloping a glass plate 80 through its side portions 21, front portion 22 and rear portions 23. Furthermore, the shelf arrangement includes at least one accessory 50 physically associated with the shelf 10 by accessory rails 60 defining at least one track 70 for displacement of the accessory 50 by its accessory frame 55.

Specifically, in accordance with this disclosure, the frame 20 comprises a plurality of receiving structures 24 and the accessory rails 60 comprise fitting projections 90, which cooperate directly with the receiving structures 24 of the frame 20, so that the accessory rails 60 are removably fit to the latter.

Thus, one of the objects of the disclosure is already achieved, namely, the modularity of the accessory rails 60 with respect to the shelf 10 to which they are associated. This modularity of the accessory rails 60 is interesting because it allows the accessory rails 60 to be made of a material different from the material of the shelf 10.

In particular, it is noted that the accessory rails 60 may be made of a polymer material, such as polypropylene (PP) or polyacetal (PA), because of their self-lubricating properties, and the frame 20 may be made of another polymeric material, such as ABS, due to its high quality finishing. The molding of the accessory rails 60 in PP or PA guarantees low wear and therefore high durability of the accessory rails 60, in addition to diminishing any noises when the accessories 50 are moved along the accessory rails 60, increasing the perceived quality of the product by the user.

Furthermore, the direct interaction between the accessory rails 60 and the frame 20, by way of the projections 90 and the receiving structures 24, eliminates any need for an intermediate element or interface between the accessory rail 60 and the frame 20, making the arrangement of the present disclosure quite simple.

In order to enable such direct interaction, the receiving structures 24 are arranged adjacent to the side portions 21 and/or the front portion 22 and the rear portion 23 of the frame 20 so as to extend transversely inward from the respective side portions 21 and/or front portion 22 and rear portion 23 of the frame 20. It should be noted that the "inward" direction is to be understood as the direction toward the respective opposing portion of the frame 20.

In other words, and in accordance with the achievement of the disclosure, some receiving structures 24 are arranged adjacent to side portions 21 opposite from the frame 20, so as to form pairs in which each of the receiving structures 24 face each other while other receiving structures 24 are arranged adjacent to the front portion 22 and along the rear portion 23 of the frame 20, so as to form at least one pair in which each of the receiving structures 24 are facing each other.

With the arrangement of the receiving structures 24 defined, it is possible to describe the format. In this sense, the receiving structures 24 are defined by an opening contour 241 which outlines an aperture 242 of a given gauge, with at least one locking hole 243 provided in the opening contour 241.

In parallel, each engaging projection 90 of the accessory rails 60 comprises at least one main portion 91 and at least one quick-fitting latch 92 extending transversely from the respective main portion 91. When its accessory rail 60 is assembled, at least one main portion 91 extends toward the aperture 242 so as to be housed within the latter, while at least one quick-fitting latch 92 engages with the locking hole 243. These details will be specified below.

In this way, a quick and secure engagement mechanism is provided between the frame 20 and the attachment rail 60, by respective receiving structures 24 and engaging projections 90 achieving another of the objectives of the disclosure.

In order to enable the possibility of various types of accessories 50, each with its own functionality, the disclosure in question allows for the provision of at least two side accessory rails 61 which engage with side receiving structures 245 arranged adjacent to the side portion 21 of the frame 20 and at least one central accessory rail 62 which engages with the central receiving structures 244 arranged along the front portion 22 and rear portion 23 of the frame 20 so as to define at least three accessory rails 60 arranged parallel to one another. Alternatively, more central accessory rails 62 could be provided as long as an adequate amount of central receiving structures 244 are also provided along the front portion 22 and the rear portion 23 of the frame 20.

More specifically, and in accordance with the achievement of the disclosure, two side receiving structures 245 are provided in a side portion 21 of the frame 20 and two other side receiving structures 245 in the opposing side portion 21. Likewise, two side accessory rails 61 are provided, each comprising two fitting projections 90, which cooperate with respective side receiving structures 245 arranged in the same side portion 21 of the frame 20.

Also, each side and central accessory rail 61, 62 comprised respectively, at least one upper flange 63 and at least one lower flange 64 joined together by a main accessory rail wall 65, with at least one track 70 arranged in the space adjacent to, at least, the upper flange 63, lower flange 64, and main accessory rail wall 65.

In this regard, it should be noted that the shape of the cross section of the side accessory rails 61 is analogous to the letter "C," while the shape of the cross section of the central accessory rail 62 is analogous to the letter "I." Thus, while each side accessory rail 61 defines a single track 70, each central accessory rail 62 defines two tracks 70. In the achievement of the disclosure, in which exactly three accessory rails 60 are provided, the central accessory rail 62 is therefore made up of a track 70 facing one of the side accessory rails 61 and also another track 70 facing another of the side accessory rails 61.

In addition, it is also pointed out that each side accessory rail 61 comprises respective main portions 91 of engaging projections 90 extending transversely from its respective main accessory rail wall 65 in the front and rear regions and each central accessory rail 62 comprises respective main portions 91 of engaging projections 90 extending longitudinally from the front and rear ends of their respective upper flanges 63.

Also, in accordance with the achievement of the disclosure, at least the main portions 91 of the side accessory rails 61 are defined by respective circumferential walls 93 which delimit respective adjustment grooves 94. Thus, as it is apparent from the figures, the main portions 91 of the side accessory rails 61 may assume a substantially rectangular contour "defining a hollow interior," wherein the circumferential walls 93 comprises dimensions analogous to the gauges of the respective apertures 242, so that there is a tight fitting between the circumferential walls 93 (or of the engaging projections 90 as a whole) and the respective apertures 242 of the side receiving structures 245 that is, by interference.

At the same time, it should be noted that the quick-fitting latch 92 includes a beveled rectangular shape, defining a kind of ramp that facilitates its sliding along the opening contour 241 as described in detail below.

This way, as respective main portions 91 of engaging projections 90 enter the aperture 242, the quick-fitting latch 92, moving juxtaposedly to the opening contour 241, is depressed so that the opening contour 241 forces both the quick-fitting latch 92 and the respective circumferential wall 93 of the main portion 91 to deform until the respective quick-fitting latch 92 encounters the locking hole 243 and its circumferential wall 93 can resume its original shape. It is precisely because of the need for such deformation of the circumferential walls 93 that the adjustment groove 94 is provided.

It should be noted that such a tight fit between engaging projections 90 and receiving structures 24 eliminates gaps and, consequently, reduces noise when the accessory 50 is displaced, i.e. upon the opening and closing of this accessory 50.

Optionally, each side receiving structure 245 includes at least one bulkhead 246 extending transversely from its respective opening contour 241, the bulkhead 246 being able to seat the main accessory rail wall 65 of the respective side accessory rail 61. This optional element, the bulkhead 246, ultimately increases the contact area between the side receiving structure 245 and the main accessory rail wall 65, facilitating engagement with the respective fitting projection 90 when mounting the side accessory rail 61, as well as providing a better grip and therefore helping to ensure correct positioning of the side accessory rail 61, even when the accessory 50 slides along its track 70, ensuring better functioning of the assembly, as well as less wear of the parts involved.

Also optionally, at least one of the accessory rails 60 includes, at its respective upper 63 and/or lower 64 flange, an accessory rail shoulder 66 able to engage with an accessory groove 56 provided in the accessory 50, to provide for secure engagement between them when the accessory 50 is in the retracted position.

On the other hand, for purposes related to the secure fitting between the shelf 10 and the internal box 30, it is expected that at least one of the walls 31 of the internal box 30 includes a respective recessed area 32 delimited by at least one upper edge 321 and a lower edge 322, with the recessed area 32 receiving a respective side portion 21 of the frame 20; the recessed area 32 comprising, in a middle area, a larger shoulder 33 projecting into the internal box 30 and extending parallel to the respective side portion 21 of the frame 20, with the larger shoulder 33 comprising a middle portion and a recess 331 extending from a first stopper 332 to a second stopper 333.

Particularly, according to this achievement, at least one of the side portions 21 of the frame 20 includes the respective coupling profile 212 which projects downward from the lower side 211 of the side portion 21 and extends in a direction parallel to that side portion 21, the coupling profile 212 including locking lugs 213 in a middle portion.

Thus, the coupling profile 212 is able to engage the larger shoulder 33 and the locking lugs 213 are able to be arranged in the shoulder 33, each juxtaposed to one of the first and second stoppers 332, 333. In this way, when fitting the shelf 10 into the shelf rail 40, the user has sensory feedback as to the secure fit between these elements, precisely because of the click made when the locking projections are juxtaposed with the respective first and second stoppers 332, 333.

It is to be noted that the coupling profile 212 extends along the longer portion of the respective side portion 21 so as to have a significant extension. Likewise, the larger shoulder 33 also extends over much of the recessed area 32 so as to increase the area of contact between the coupling profiles 212 and the larger shoulder 33 and, consequently, ensure adherence and a secure fit between these elements.

In this case, it is pointed out that the at least one of the shelf rails 40 is defined at least by the combination of the recessed area 32 and the larger shoulder 33. The shelf rail 40, even while being defined in this manner, may even be made according to known techniques, that is, molded together with the internal box 30 of the appliance or separately and subsequently attached by any suitable process.

Additionally and optionally, to further improve the positioning/mounting of the shelf 10 adjacent to the respective shelf rail 40, a smaller shoulder 34 may be provided adjacent to the upper edge 321 at the rear, i.e. closer to the bottom of the internal box 30.

Finally, to exemplify some of the features that the disclosure provides, it is pointed out that the accessory 50 may assume the configuration of a fruit and vegetable drawer 51, as well as a configuration of wires arranged in a parallel fashion supporting a curved plastic plate for placing bottles, defining a wine bottle holder 52 or, as another option, small drawers 53 for storing the most varied types of articles. Each type of accessory 50, regardless of its particular configuration, also includes the accessory frame 55 which engages with respective tracks 70 defined by the accessory rails 60.

It is important to note that the sole objective of the above description is to describe in an exemplary manner a particular achievement of the disclosure in question. Nevertheless, it is clear that modifications, variations and constructive combinations of elements performing the same function in substantially the same manner to achieve the same results, remain within the scope of protection delimited by the appended claims.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments are illustrative. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present disclosure, and further it is to be understood that such concepts are intended to be covered by the following claims unless these claims by their language expressly state otherwise.

What is claimed is:

1. A household appliance comprising:

a shelf comprising a frame that includes side receiving structures, wherein the frame includes a coupling profile with latching lugs, and wherein the coupling profile is engageable with a shoulder within a recessed area of a wall of said household appliance with the latching lugs adjacent to stoppers;

at least two side accessory rails that engage the side receiving structures of the frame, wherein each side receiving structure is defined by an opening contour that delimits an aperture and includes at least one bulkhead extending transversely from the aperture;

at least one central accessory rail that engages with at least one central receiving structure arranged adjacent front and rear portions of the frame, wherein each of the at least two side accessory rails and the at least one central accessory rail are comprised of, respectively, at least one upper flange and at least one lower flange joined together by a main accessory rail wall, wherein at least one track is arranged in a space adjacent to the at least one upper flange, the at least one lower flange, and the main accessory rail wall; and wherein the at least two side accessory rails include fitting projections extending transversely from each of the main accessory rail walls and the at least one central accessory rail comprises an engaging projection extending longitudinally from a front end and a rear end of the at least one upper flange.

2. The household appliance of claim 1, further comprising:

an opening contour in the at least one central receiving structure that delimits an aperture, wherein each of the fitting projections of the at least two side accessory rails includes at least one main portion which, when the accessory rails are assembled, extends in the direction of the aperture.

3. The household appliance of claim 1, wherein the at least two side accessory rails define respective circumferential walls which outline adjustment features.

4. The household appliance of claim 1, further comprising:

an accessory configured to engage at least one of the at least two side accessory rails, wherein at least one of the at least two side accessory rails includes an accessory rail projection able to engage with an accessory groove defined by the accessory.

5. The household appliance of claim 1, wherein the frame is made of a first polymeric material and the at least two side accessory rails are made of a second polymeric material.

6. A household appliance comprising:

a plurality of walls, wherein at least one of the walls defines a recessed area delimited by at least one upper edge and at least one lower edge, wherein the recessed area receives a frame, and wherein the frame includes a coupling profile having latching lugs, the coupling profile being engageable with a shoulder within the recessed area and the latching lugs are adjacent to first and second stoppers;

a shelf received within the recessed area, the shelf including a frame;

side receiving structures coupled to the frame, wherein the side receiving structures are defined by an opening contour that delimits an aperture, and wherein at least one latching hole is provided in the opening contour, and wherein each of the side receiving structures includes at least one bulkhead extending transversely from the aperture; and side accessory rails defining at least one track for displacement of an accessory physically associated with the shelf, wherein the side accessory rails engage the side receiving structures arranged adjacent to side portions of the frame.

7. The household appliance of claim 6, wherein a fitting projection of the side accessory rails includes at least one main portion extending in the direction of the aperture and at least one quick-fitting latch capable of engaging the at least one latching hole, the at least one quick-fitting latch extending transversely from the main portion.

8. The household appliance of claim 6, further comprising:

a central accessory rail engaged with central receiving structures arranged adjacent to front and rear portions of the frame.

9. The household appliance of claim 8, wherein each of the side accessory rails and the central accessory rail is comprised of at least one upper flange and at least one lower flange joined together by a main accessory rail wall.

10. The household appliance of claim 9, wherein each of the side accessory rails comprises main portions of fitting projections extending transversely from the main accessory rail walls, and the central accessory rail comprises main portions of engaging projections extending longitudinally from front and rear ends of the at least one upper flange.

11. The household appliance of claim 9, further comprising:

an accessory, wherein the central accessory rail includes, on at least one of the upper flange and the lower flange, an accessory rail projection able to engage with an accessory groove provided in the accessory.

12. The household appliance of claim 6, wherein the at least one bulkhead seats a main accessory rail wall of the at least two side accessory rails.

13. The household appliance of claim 6, wherein the side accessory rails define respective circumferential walls which outline adjustment features.

14. The household appliance of claim 6, wherein the frame is made of a first polymeric material and the side accessory rails are made of a second polymeric material.

15. A household appliance comprising:

a shelf comprising a frame operably coupled with walls of an internal box by shelf rails, wherein the frame comprises opposing side portions that each include a coupling profile configured to engage with a shoulder of at least one of the walls, wherein the frame includes a plurality of receiving structures coupled to the opposing side portions, a front portion, and a rear portion of the frame, the plurality of receiving structures extending transversely inward from the opposing side portions and the front and rear portions of the frame, respectively, wherein the receiving structures are defined by an opening contour that delimits an aperture and include at least one bulkhead extending transversely from the aperture, wherein at least one latching hole is provided in the opening contour;

at least one accessory physically associated with the shelf;

at least two side accessory rails configured to engage the receiving structures coupled to the side portions of the frame, wherein each of the at least two side accessory rails comprises respective main portions of fitting projections extending transversely from a main accessory rail wall; and at least one central accessory rail configured to engage the receiving structures coupled to the front and rear portions of the frame, wherein the at least one central accessory rail comprises respective main portions of engaging projections extending longitudinally from front and rear ends of at least one upper flange.

16. The household appliance of claim 15, further comprising:

a quick-fitting latch capable of engaging the at least one latching hole, the quick-fitting latch extending from each of the fitting projections.

17. The household appliance of claim 15, wherein the at least one central accessory rail is configured to engage with at least one central receiving structure arranged adjacent the front and rear portions of the frame, wherein each of the at least two side accessory rails and the at least one central accessory rail is comprised of the at least one upper flange and at least one lower flange joined together by the main accessory rail wall.

* * * * *